US005870796A

United States Patent [19]

Yasoshima

[11] Patent Number: 5,870,796

[45] Date of Patent: Feb. 16, 1999

[54] BUFFER BRUSH FOR STENCILING

[75] Inventor: Rira Yasoshima, Tokyo, Japan

[73] Assignee: Tsukineko, Inc., Redmond, Wash.

[21] Appl. No.: 747,354

[22] Filed: Nov. 12, 1996

[51] Int. Cl.[6] ..... A47L 13/28; A46B 15/00

[52] U.S. Cl. ..... 15/244.1; 15/143.1; 15/106

[58] Field of Search ..... 15/104.001, 104.94, 15/106, 143.1, 244.1, 244.4; 101/405, 406, 333; 401/6

[56] References Cited

U.S. PATENT DOCUMENTS

| | | | |
|---|---|---|---|
| D. 184,720 | 3/1959 | Fleming . | |
| D. 247,063 | 1/1978 | Funahashi . | |
| D. 252,935 | 9/1979 | Henkels . | |
| D. 331,418 | 12/1992 | Winston . | |
| D. 345,826 | 4/1994 | Byars et al. . | |
| D. 347,089 | 5/1994 | Byars et al. . | |
| D. 369,384 | 4/1996 | Yasoshima . | |
| D. 372,731 | 8/1996 | Yasoshima . | |
| 602,061 | 4/1898 | Echelberger . | |
| 771,435 | 10/1904 | Metcalf | 101/405 |
| 848,063 | 3/1907 | Sommer . | |
| 1,173,092 | 2/1916 | Bickerton . | |
| 1,463,718 | 7/1923 | Munson . | |
| 1,478,388 | 12/1923 | Gray | 15/244.1 |
| 1,598,538 | 8/1926 | Mann . | |
| 1,796,137 | 3/1931 | Baumgarten . | |
| 2,117,470 | 5/1938 | Zareko . | |
| 2,173,451 | 9/1939 | Lorber | 15/143.1 |
| 2,237,969 | 4/1941 | Olsen | 15/143.1 |
| 2,290,488 | 7/1942 | Munson . | |
| 2,374,198 | 4/1945 | Harris . | |
| 2,422,814 | 6/1947 | Alexander . | |
| 2,664,582 | 1/1954 | Kammann | 15/143.1 |
| 2,723,476 | 11/1955 | Lyon . | |
| 2,873,464 | 2/1959 | Rosenthal | 15/104.001 |
| 2,964,772 | 12/1960 | Crawford | 15/244.1 |
| 3,142,855 | 8/1964 | Gilchrist | 15/244.1 |
| 3,326,180 | 6/1967 | Lofgren . | |
| 3,590,734 | 7/1971 | Carter . | |
| 4,029,011 | 6/1977 | Kurner . | |
| 4,283,808 | 8/1981 | Beebe | 401/6 |
| 4,986,175 | 1/1991 | Boehringer et al. . | |
| 5,531,829 | 7/1996 | Yasoshima . | |
| 5,601,644 | 2/1997 | Yasoshima . | |
| 5,671,497 | 9/1997 | Abdo | 15/244.1 |

FOREIGN PATENT DOCUMENTS

| | | |
|---|---|---|
| 546609 | 9/1957 | Canada . |
| 167 380 A | 1/1986 | European Pat. Off. . |
| 2675740 A1 | 10/1992 | France . |
| 662905 | 6/1938 | Germany . |
| 4-312881 A | 11/1992 | Japan . |
| 4940 | of 1896 | United Kingdom . |
| 2045687 | 11/1980 | United Kingdom . |

OTHER PUBLICATIONS

Rubber stamp catalog, Clearsnap, Inc., 1990.

Tsukineko, Japanese Catalog, 1993.

Clearsnap, Color Box Pigment Stamp Pads, See circled stamp pad, top left, 1993.

*Primary Examiner*—Terrence Till

*Attorney, Agent, or Firm*—Seed and Berry LLP

[57] ABSTRACT

A buffer brush for stenciling with which the user's hand will not get tired even if it taps the handle for a long time to stencil ink, and the close contact of the ink absorbing part and the stencil will be good. The buffer brush comprises an ink absorbing part (2) on a handle (1) which is made of buffer material.

10 Claims, 2 Drawing Sheets

BUFFER BRUSH FOR STENCILING

This application claims priority from Japanese U.M. Application No. 8-1467, filed Feb. 15, 1996 and registered as U.M. Reg. No. 3,027,984 on Jun. 6, 1996, which application is hereby incorporated herein by reference in its entirety.

FIELD OF THE INVENTION

The present invention pertains to buffer brushes for stenciling, particularly buffer brushes for stenciling that have buffer characteristics, because buffer material is used for the handle.

BACKGROUND OF THE INVENTION

Conventionally, stenciling is done as follows: Stencils with letters, figures, or designs cut out are fixed onto a sheet of paper. Watercolors (water-soluble paint), or ink from a stamp pad is transferred to a stencil brush, then the artist colors by slightly tapping the stencil brush on the top of the stencil. Then, afterward, the stencil is removed and the letters, figures, or designs are copied.

Stencil brushes used for conventional stencils can have, as illustrated in FIG. 4, a brush (13) of animal hair, etc., attached to the tip of a wooden or bamboo handle (11), or as illustrated in FIG. 5, an ink absorbing part (12) of polyurethane sponge, etc., attached to the tip of a handle (11*a*) of wood, bamboo, or hard plastic. The artist holds the handle with his or her fingers in the same manner as a pencil, and colors with ink by slightly tapping the brush on top of the stencil.

However, such conventional stencil brushes have the following problem: Because the handle is made of hard material such as wood, bamboo, or hard plastic, when the user taps the handle to dispense the ink, the impact of the tapping force returns to the fingers through the handle, because the force is not absorbed by the hard handle, stencil, or paper. Thus, the user receives an impact on the fingers all the time, and the fingers get tired if tapping is continued for a long time period.

Also, because the impact of the force, which taps the stencil brush, returns through the handle (11), the handle bounces, and disrupts the close contact between the brush (13) or ink absorbing part (12), the stencil and the paper. Thus, the quantity of ink released from the brush by one time of tapping is small, resulting in the need for more tapping on the stencil brush. The fingers therefore receive impact more frequently, and the hand gets tired.

The present invention improves such a problem of the prior art. The purpose is to offer a buffer brush for stenciling as follows: By providing buffer characteristics by using buffer material for the handle of a stencil brush, the impact of the force of tapping the stencil brush is absorbed by the buffer material of the handle. Thus, the hand will not be tired even if the user taps for a long time period. Also, there will be close contact between the ink absorbing part, the stencil and the paper.

SUMMARY OF THE INVENTION

The present invention is a buffer brush for stenciling, characterized by the fact that an ink absorbing part is provided on a handle that comprises buffer material.

The handle of the stencil brush is constructed with buffer material which provides buffering characteristics. Thus, the impact of the tapping force generated when the stencil brush is used to stencil ink can be absorbed by the buffer material of the handle. Thus, the hand will not be tired even if the stencil brush is tapped for a long time period. Also, because buffer characteristics are provided by constituting the handle of the stencil brush with buffer material so the tapping force on the handle is relieved by the buffer material, there will be closer contact between the ink absorbing part, the stencil, and the paper. The quantity of ink applied by one tap increases, and thus the user will need to tap less often.

DETAILED DESCRIPTION OF THE INVENTION

The present invention will be explained in concrete terms based on the figures.

Figure 1:
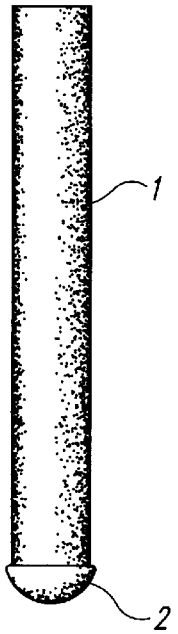
FIG. 1 is an explanatory diagram which illustrates an example of the buffer brush for stenciling of the present invention.

FIG. 1 is an explanatory diagram which illustrates an example of the buffer brush for stenciling of the present invention. As illustrated in this FIG. 1, the buffer brush for stenciling of the present invention is characterized by the fact that it is constructed by providing an ink absorbing part (2) on a handle (1) made of buffer material.

The handle (1) is made of buffer material. The buffer material has buffering characteristics, and is hard enough to transmit the tapping force to the ink absorbing part (2). For instance, plastic foaming substance, rubber foaming substance, other foaming substances, or sponges are preferable. Concrete examples include a plastic foaming substance or sponge of polyethylene-vinyl acetate copolymer (EVA), etc., or a rubber foaming substance or sponge such as etc.

There is no specific limit in terms of the shape of the handle (1). The shape of its cross section may be a circle, oval, triangle, quadrangle, hexagon, or other polygon.

The ink absorbing part (2) may be one which is used for conventional stencil brushes. For instance, a polyurethane plastic sponge is preferable. Animal hair may also be used.

The buffer brush for stenciling of the present invention can be easily prepared by gluing the ink absorbing part (2) with an adhesive to the tip of the handle (1) made of buffer material.

Figure 2:
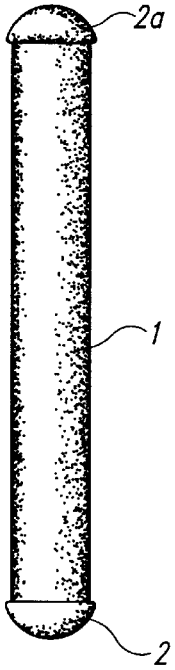
FIG. 2 is an explanatory diagram which illustrates another example of the buffer brush for stenciling of the present invention.

In FIG. 1, the ink absorbing part (2) is provided at one end of the handle (1). For the buffer brush for stenciling of the present design, an ink absorbing part (2) may also be provided at each end of the handle (1) as illustrated in FIG. 2. In such a case, with one buffer brush for stenciling, two colors of ink can be used.

Figure 3:
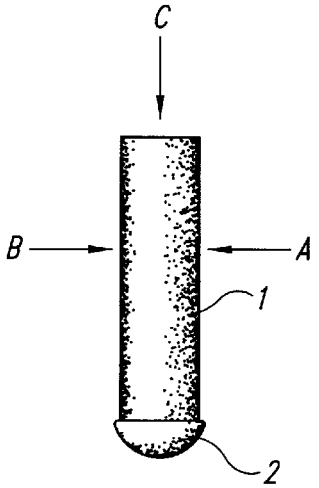
FIG. 3 is an explanatory diagram which illustrates still another example of the buffer brush for stenciling of the present invention.
Figure 4:
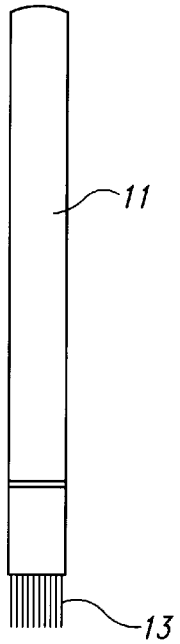
FIG. 4 is an explanatory diagram which illustrates a conventional stencil brush.
Figure 5:
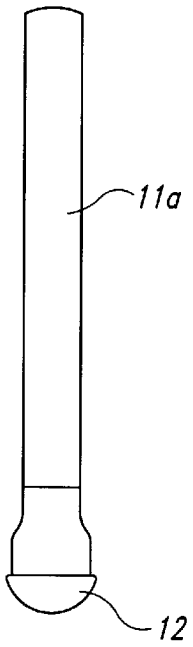
FIG. 5 is an explanatory diagram which illustrates another conventional stencil brush.

The length of the handle (1) of the buffer brush for stenciling of the present design can be arbitrary. For instance, the handle may be long enough for the user to hold with two fingers in the same manner as holding a pencil and to tap it on the stencil. Also, as illustrated in FIG. 3, the handle may be long enough for the user to support the handle walls (A) and (B) with his thumb and middle finger, respectively, and to press the top end (C) of the handle (1) with the index finger, i.e., 20–30 mm. This length is preferable because the user can tap it in a stable manner using three fingers, and because the hand will not get tired even if it is tapped for a long time period.

APPLICATION EXAMPLE

The present design will be explained below in concrete terms in reference to application examples.

APPLICATION EXAMPLE 1

A buffer brush for stenciling such as illustrated in FIG. 1 was prepared.

For the buffer material, polyethylene foaming sheet, which is 25 mm thick, was punched with a punching blade, and a handle (1) composed of cylindrical polyethylene foaming substance, which is 25 mm long with the diameter of 10–20 mm, was prepared. At the tip of this polyethylene foaming substance handle (1), an ink absorbing part (2) of polyurethane sponge with a round bottom face of 10–20 mm, which forms a spherical shape upward, was glued to the handle.

Stenciling was performed using this buffer brush for stenciling. A stencil with flower designs punched out was fixed onto a sheet of paper, the ink from the stamp pad was applied to the ink absorbing part of the buffer brush, and the stenciling was performed by tapping the buffer brush on top of the stencil. By the buffer action of the polyethylene foaming substance of the handle, the impact of the tapping force was absorbed, and it did not affect the user's hand. Thus, the user's hand did not get tired even after tapping for a long time period. The tapping force was relieved by the polyethylene foaming substance, and there was close contact between the ink absorbing part, the stencil, and the paper.

As explained above, because the handle of the buffer brush for stenciling of the present design is made of buffer material, the impact of the force of tapping the brush is absorbed by the buffer material of the handle, and the hand will not get tired even if the brush is tapped for a long time.

Because the handle was made of buffer material with buffering characteristics, the force of tapping the handle is relieved by the buffer material. Thus, there will be close contact with the ink absorbing part, stencil, and paper, the quantity of ink which is applied by tapping once will be great, and thus, the number of tappings can be reduced.

What is claimed is:

1. A buffer brush for stenciling comprising an ink absorbing part attached to an elongated handle, the elongated handle comprising buffer material and being elongated along an axis that extends away from the ink absorbing part, the ink absorbing part being configured to release ink when tapped against a stencil, the ink absorbing part further having an extent in any direction generally orthogonal to the axis that is approximately the same as or less than an extent of the handle in the same direction.

2. The buffer brush for stenciling in accordance with claim 1 wherein the buffer material comprises a plastic foaming substance.

3. The buffer brush for stenciling in accordance with claim 1 wherein the buffer material comprises a rubber foaming substance.

4. The buffer brush for stenciling in accordance with claim 1 wherein the ink absorbing part comprises a sponge.

5. The buffer brush for stenciling in accordance with claim 1 wherein the ink absorbing part is provided at a first end of the handle.

6. The buffer brush for stenciling in accordance with claim 5 wherein the length of the handle is a length that allows a thumb and a middle finger of a user to support the handle and an index finger of the user to press a second end of the handle.

7. The buffer brush for stenciling in accordance with claim 1 wherein the ink absorbing part is provided on both ends of the handle.

8. The buffer brush of claim 1 wherein the handle has a first end proximate to the ink absorbing part and a second end opposite the first end, a distance between the first end and the second end being in the range of approximately 20 mm to approximately 30 mm to provide stability and control during use.

9. The buffer brush of claim 1 wherein a first portion of the ink absorbing part has an extent in any first direction generally orthogonal to the axis that is approximately the same as an extent of the handle in the first direction, further wherein a second portion of the ink absorbing part has an extent in any second direction generally orthogonal to the axis that is less than an extent of the handle in the second direction.

10. A buffer brush for stenciling, comprising:

an elongated handle comprising buffer material and having first and second ends;

a first ink absorbing part attached to the first end of the handle; and a second ink absorbing part attached to the second end of the handle.

* * * * *